United States Patent [19]

Dorsey

[11] 4,425,449

[45] Jan. 10, 1984

[54] DECORATIVE SYNTACTIC FOAM PRODUCTS

[75] Inventor: William C. Dorsey, Manor Township, Westmoreland County, Pa.

[73] Assignee: Armstrong World Industries, Inc., Lancaster, Pa.

[21] Appl. No.: 369,918

[22] Filed: Apr. 19, 1982

[51] Int. Cl.[3] ..... C08J 9/32

[52] U.S. Cl. ..... 523/218; 521/54; 521/73; 521/75; 523/219; 524/444; 264/331.15; 264/DIG. 6; 264/DIG. 60; 428/313.7; 428/313.9 317.9

[58] Field of Search ..... 523/218, 219; 524/444; 264/331.15, DIG. 6, DIG. 60; 428/313.7, 313.9, 317.9; 521/54, 73, 75

[56] References Cited

U.S. PATENT DOCUMENTS 3,786,004 1/1974 Furuya et al. ..... 521/93

3,855,160 12/1974 Shiotsu et al. ..... 521/138

*Primary Examiner*—Morton Foelak

*Attorney, Agent, or Firm*—Laird F. Miller

[57] ABSTRACT

A mixture of vinyl plastisol, suspension grade resin and expanded perlite is prepared in a manner such that the particles of perlite are not significantly damaged. The mixture is placed on a substrate and fused, thereby producing a foam-like material which is usable as a decorative covering. Alternatively, the mixture can be cast on a release surface and allowed to stand until the majority of the perlite particles have migrated to the top surface, thus leaving a layer of material containing substantially no perlite along the lower surface which interfaces with the release surface. Upon fusing this stratified mixture and separating the release surface, the fused material is inverted. The layer of material which contains substantially no perlite becomes the protective surface and the remaining portion of the fused material, which is foam-like in nature, becomes the resilient support. Such syntactic foams may be used as replacements or substitutes for mechanically frothed or chemically blown foams.

25 Claims, No Drawings

DECORATIVE SYNTACTIC FOAM PRODUCTS

The present invention relates to decorative coverings and more particularly to decorative syntactic foam products.

BACKGROUND OF THE INVENTION

Foamed products and processes for making them have been extensively investigated, resulting in the development of foamed products which are used as floor coverings, wall coverings and the like. These investigations have led to many highly technical production methods, such as methods utilizing chemical blowing agents. Such methods often involve multiple steps which tend to be time-consuming and expensive. Accordingly, the industry is constantly trying to find new yet simplifed methods of manufacturing these foamed products.

THE PRIOR ART

Most foamed flooring products are presently prepared either by mechanical means, such as by mechanically frothing a vinyl plastisol which is then placed on a backing material, or by chemical means, in which case a foamable plastisol is placed on a backing and foamed using chemical blowing agents which are well known in the art. However, the cost of preparing such foamed materials can be relatively high because of the number of steps involved. Furthermore, the application of wear layers can increase these costs even further.

Accordingly, one object of the present invention is to provide a unitary low-density flooring which has the attributes of foamed vinyl flooring, but which does not possess the inherent disadvantages of foamed flooring.

Yet another object of the present invention is to provide a single step process by which a foam-like flooring having an integrated wear layer can be produced.

Still another object of the present invention is to provide syntactic foam products which will be useful as decorative coverings, such as wall coverings, which are adaptable to a variety of environments.

These and other features of the present invention will become apparent from the disclosure of preferred embodiments which follow.

SUMMARY OF THE INVENTION

A mixture of vinyl plastisol, suspension grade resin and expanded perlite is prepared in a manner such that the particles of perlite are not significantly damaged. The mixture is placed on a substrate and fused, thereby producing a foam-like material which is usable as a decorative covering. Alternatively, the mixture can be cast on a release surface and allowed to stand until the majority of the perlite particles have migrated to the top surface, thus leaving a layer of material containing substantially no perlite along the lower surface which interfaces with the release surface. Upon fusing this stratified mixture and separating the release surface, the fused material is inverted. The layer of material which contains substantially no perlite becomes the protective surface and the remaining portion of the fused material, which is foam-like in nature, becomes the resilient support. Such syntactic foams may be used as replacements or substitutes for mechanically frothed or chemically blown foams.

DETAILED DESCRIPTION OF PREFERRED EMBODIMENTS

In one embodiment, the present invention comprises a process for producing a syntactic foam structure, said process comprising the steps of preparing a mixture comprising from about 65 to about 99 percent by weight of vinyl plastisol, from 0 to about 30 percent by weight of suspension grade resin and from about 1 to about 10 percent by weight of expanded perlite comprised essentially of particles having a diameter of from about 50 to about 1000 microns. The mixture is spread to a desired thickness on a substrate and fused.

In a second embodiment, the present invention comprises a process for producing a syntactic foam structure having an integrated protective layer, said process comprising the steps of preparing a mixture comprising from about 65 to about 99 percent by weight of vinyl plastisol, from 0 to about 30 percent by weight of suspension grade resin, and from about 1 to about 10 percent by weight of expanded perlite comprised essentially of particles having a diameter of from about 50 to about 1000 microns. The mixture is spread to a desired thickness on a release surface and the perlite is permitted to rise to the upper surface of the mixture, thereby leaving a layer of material comprising essentially no perlite at the lower surface thereof, said lower surface interfacing with said release surface. The stratified material is fused and separated from said release surface.

In a third embodiment, the present invention comprises a syntactic foam structure obtained by fusing a mixture comprising from about 65 to about 99 percent by weight of vinyl plastisol, from 0 to about 30 percent by weight of dry blend resin and from about 1 to about 10 percent by weight of expanded perlite comprised essentially of particles having a diameter of from about 50 to about 1000 microns.

Syntactic foams are pseudo foams in which the bubbles responsible for the foam-like character are formed prior to inclusion in the matrix material. For example, if microspheres or hollow particles consisting of glass, ceramic, carbon or plastic are embedded in a matrix, the resulting product is a syntactic foam. Such foams have been known for many years to have utility in producing molded furniture, deep water plastic floats and other materials in which the cast foam would be subjected to stress. However, the spheres used to produce these materials have been of sturdy construction, phenolic resins and glass spheres being the main types of additives.

Surprisingly, we have found that a low-density syntactic foam structure may be constructed using expanded perlite as the preformed bubbles. Expanded perlite is extremely light in weight, having a bulk density as low as 3 to 5 pounds per cubic foot. Unlike the aforementioned materials, many expanded perlite particles have an open-celled structure with fairly irregular surface characteristics. Perlite is also a very fragile material which is easily crushed. Accordingly, it is unexpected and surprising to find that suitable structures comprising expanded perlite can be produced, and even more surpising to find that such structures are suitable as flooring materials. When used for this purpose, the syntactic foams of the present invention can be embossed, coated and subjected to temperature and pressure conditions which would cause frothed or chemically blown plastisol foams to collapse.

To practice the present invention, a vinyl plastisol is prepared by means well known in the art. Plastisols conventionally comprise a dispersion grade resin, a blending resin and a plasticizer. Virtually any dispersion grade resin and blending resin can be employed although polyvinyl chloride homopolymers are preferred. Typically, dispersion grade resins have a particle size of from about 0.5 to about 2 microns, whereas blending resins have a particle size of from about 10 to about 250 microns. Virtually any plasticizer compatible with these resins may be used, although dioctyl phthalate is preferred. Typically, the plastisol will contain about 50 to 80 parts by weight of plasticizer for every 100 parts of resin, and it may also contain other additives, such as stabilizers, pigments, decorative chips and the like.

Furthermore, the mixture may comprise from 0 to about 30 percent by weight of a suspension grade resin to enhance the cellular characteristics and workability of the resulting product. As used herein, the term suspension grade resin will include dry blended resins, which are resins that have been treated with a plasticizer. Virtually any suspension grade resin may be used although vinyl homopolymers are preferred.

In preparing the perlite-containing mixture, it is preferable to mix all of the components except the perlite with the plastisol and then, as the last step, to mix in the expanded perlite; however, a low-shear blender should be used in mixing the perlite in order to avoid damaging the perlite cells. The perlite cells will be comprised essentially of particles having a diameter of from about 50 to about 1000 microns, but preferably the majority of the particles will be from about 100 to about 500 microns in diameter. From about 1 to about 10 percent by weight of perlite may be used to practice the present invention, although from about 2 to about 6 percent is preferred.

After mixing is complete, the present invention takes one of several alternative courses. In one alternative, the mixture may be cast upon a substrate and immediately fused, or it may be cast on a release surface and allowed to stand for several minutes until the lightweight perlite has migrated to the upper surface of the plastisol, at which point the mixture can be fused. In the former case, a product having a relatively uniform foam-like structure is obtained, and this material may be used in a variety of ways. For example, if the substrate is a conventional floor backing, the structure may be used as is, or it may be further provided with a wear layer or other protective covering. In addition, if the substrate is of a different type, such as fibrous, glass reinforcing, the product may be used as is as a decorative wall covering, or incorporated into a more complex structure. A good example of the latter is a reinforced syntactic foam flooring structure having a polyurethane foam backing and, optionally, an added wear layer. Of course, all such possibilities and variations thereof are contemplated by the present invention.

When the perlite is migrated as set forth above, a product having a relatively stratified structure is obtained. When this latter material is inverted, the resulting flooring structure has a lower foam-like layer and an upper wear surface. Of course, by varying the amount of time allowed for migration, widely variable structural characteristics may be obtained.

Other additives may also be migrated within the plastisol matrix. For example, if it is desired to have decorative chips in the wear surface, chips with a specific gravity perhaps 10 to 20 percent greater than that of the plastisol can be added. As the perlite migrates to the upper surface, the chips will sink to the lower surface, thereby giving a decorative effect to the fused product. Of course, when migration of perlite and a heavier additive is intended, care must be taken to avoid using excess amounts of these materials because each will tend to interfere with the migration of the other.

It must also be noted that the viscosity of the plastisol may require consideration. This is particularly true where the perlite must migrate so as to stratify the mixture because, if the viscosity is too high, migration may be severly hindered or entirely prevented. When migration is not required, maintaining a low viscosity is not as critical and viscosities ranging from about 500 up to about 30,000 cps may be employed. Nevertheless, high viscosities are not desirable because they tend to cause non-uniform mixing of the ingredients and/or breaking of the fragile perlite particles. For these reasons, viscosities of from about 500 to about 10,000 cps are preferred when migration is not contemplated whereas, when migration is desired, viscosities of from about 500 to about 5000 cps are preferred. In the latter case, however, viscosities on the order of about 700 to about 2000 are most preferred.

Depending on the purpose for which the aforementioned products are intended, they may be used without further modification, or they may be printed with a design, embossed, have a wear layer applied, or be otherwise modified by means well known in the art.

The utility of the syntactic foams, particularly as floor coverings, may be seen from the following. One test of a flooring product is its resistance to damage when a heavy object is dragged across its surface. A convenient way to approximate this condition is by holding a key (e.g., a car key) with force against a protective surface which overlies a foam, and then pulling the key across the surface. When this key test was applied to a conventional foam and a uniform syntactic foam of the present invention, each protected with a 10-mil vinyl wear layer, very dissimilar results were obtained. The conventional foam underlayment puckered and gathered under the applied stress, and the composite structure, including the wear layer, eventually tore. Conversely, the syntactic foam did not pucker and gather, and the only damage noted was a scratching of the wear layer by the key.

Another advantage of such syntactic foam products is that they can be made to a desired gauge and they tend to maintain that gauge, even after further processing. Conventional foams made using chemical blowing agents tend to lack uniformity because initial defects and surface variations are magnified when the chemical blowing agents expand. The syntactic foams of the present invention overcome this disadvantage because the product gauge can be closely controlled.

The following examples are provided to illustrate but not to limit, the advantages which may be obtained through the use of the present invention.

EXAMPLES

All of the examples illustrated herein were prepared using a plastisol having the following composition and having a viscosity of about 1000 cps.

| Ingredient | Parts by Weight |
|---|---|
| Dispersion grade resin (Firestone 6337) | 80 |

-continued

| Ingredient | Parts by Weight |
|---|---|
| Blending resin (Tenneco 501) | 20 |
| Dioctyl phthalate plasticizer | 60 |
| Stabilizer (Argus M-275) | 2 |

EXAMPLES I–IV

Examples I–IV were prepared from the following components

| Ingredient | Example (parts by weight) | | | |
|---|---|---|---|---|
| | I | II | III | IV |
| Plastisol | 100 | 100 | 100 | 100 |
| Perlite | 2.5 | 5.0 | 2.5 | 2.5 |
| Plasticized suspension grade resin (Firestone 9290) | — | — | 5 | — |
| Colorquartz (3-M Company) | — | — | — | 5 |

The expanded perlite in each case had a bulk density of about 4.0±0.5 pounds per cubic foot and was comprised of small particles, approximately 80 percent of which were between 700 and 200 microns in diameter. For Examples I and II, the perlite was carefully mixed with the plastisol and then each mixture was cast into two Teflon ®-coated steel molds having dimensions of 6"×6"×0.125". One mold for each example (label Examples I*a* and II*a*, respectively) was immediately heated at 385° F. for 20 minutes to fuse the material whereas the other two molds (Examples I*b* and II*b*) were allowed to stand at room temperature for two minutes and then similarly fused. Upon cooling, the samples were separated from the molds and examined microscopically. Examples I*a* and II*a* showed a fairly uniform distribution of perlite particles, whereas Example I*b* showed a definite layer comprising substantially no perlite particles at the interface of the mold and the fused plastisol. Example II*b* did not show the same definite, perlite-free layer, thus indicating that the increased level of perlite tends to cause interference with the migration.

Examples III and IV were prepared by premixing the resin or the Colorquartz, respectively, with the plastisol and then carefully mixing in the perlite. The mixed samples were cast in molds, allowed to stand for two minutes and fused as described above. Microscopic examination of Example III showed that the perlite had migrated to the top surface, as expected, but that the suspension grade resin had shown no tendency to migrate. Example IV showed that the Colorquartz, a high-density material, had concentrated along the lower surface whereas the perlite had migrated to the top surface. Thus, under appropriate conditions, different types of particles may be migrated within the plastisol to give a decorative protective layer at one surface and a syntactic foam at another surface.

EXAMPLE V

This example illustrates the preparation of a flooring structure in which a perlite-containing plastisol is cast on a permanent flooring carrier. The composition of Example III, comprising 2.5 parts of perlite and 5.0 parts of plasticized suspension grade resin for every 100 parts of plastisol, was prepared as previously described, cast on a conventional permanent flooring carrier, allowed to stand for two minutes, and fused in an oven at 385° F. for 3 minutes. When cool, a 20-mil layer of plastisol was coated onto the layered material and fused for 2 minutes at 385° F. The resulting fused structure comprised, in order, a backing, a vinyl layer comprising essentially no perlite, a layer of syntactic foam, and a superimposed vinyl wear layer.

The present invention is not limited solely to the descriptions and illustrations provided above, but encompasses all modifications encompassed by the following claims.

What is claimed is:

1. A process for producing a syntactic foam structure, said process consisting essentially the steps of:

(a) preparing a mixture comprising from about 65 to about 99 percent by weight of vinyl chloride polymer plastisol, from 0 to about 30 percent by weight of suspension grade resin and from about 1 to about 10 percent by weight of expanded perlite comprised essentially of particles having a diameter of from about 50 to about 1000 microns;

(b) spreading said mixture to a desired thickness on a substrate; and (c) fusing the spread material.

2. The invention as set forth in claim 1 hereof wherein said perlite is comprised essentially of particles having a diameter of from about 100 to about 500 microns.

3. The invention as set forth in claim 1 hereof wherein said mixture comprises from about 2 to about 6 percent by weight of said perlite.

4. The invention as set forth in claim 3 hereof wherein said perlite is comprised essentially of particles having a diameter of from about 100 to about 500 microns.

5. The invention as set forth in claims 1, 2, 3, or 4 hereof wherein said substrate is a release surface.

6. The invention as set forth in claims 1, 2, 3 or 4 hereof wherein the viscosity of said plastisol is from about 500 to about 100 cps.

7. The invention as set forth in claims 1, 2, 3 or 4 hereof wherein said perlite is allowed to migrate before the spread material is fused, the viscosity of said plastisol being from about 500 to about 5,000 cps.

8. The invention as set forth in claim 7 hereof wherein said mixture comprises a material having a specific gravity greater than the specific gravity of said plastisol.

9. The invention as set forth in claim 7 hereof wherein the viscosity of said plastisol is from about 700 to about 2,000 cps.

10. The invention as set forth in claim 8 hereof wherein the viscosity of said plastisol is from about 700 to about 2,000 cps.

11. A process for producing a syntactic foam structure having an integrated protective layer, said process consisting essentially of the steps of:

(a) preparing a mixture comprising from about 65 to about 99 percent by weight of vinyl chloride polymer plastisol, from 0 to about 30 percent by weight of suspension grade resin, and from about 1 to about 10 percent by weight of expanded perlite comprised essentially of particles having a diameter of from about 50 to about 1000 microns;

(b) spreading said mixture to a desired thickness on a release surface;

(c) permitting said perlite to rise to the upper surface of said mixture, thereby leaving a layer of material comprising essentially no perlite at the lower surface thereof, said lower surface interfacing with said release surface;

(d) fusing the stratified material; and (e) separating the fused material from said release surface.

12. The invention as set forth in claim 11 hereof wherein said perlite is comprised essentially of particles having a diameter of from about 100 to about 500 microns.

13. The invention as set forth in claim 11 hereof wherein said mixture comprises from about 2 to about 6 percent by weight of said perlite.

14. The invention as set forth in claim 13 hereof wherein said perlite is comprised essentially of particles having a diameter of from about 100 to about 500 microns.

15. The invention as set forth in claims 11, 12, 13 or 14 hereof wherein the viscosity of said plastisol is from about 500 to about 5,000 cps.

16. The invention as set forth in claim 15 hereof wherein said mixture comprises a material having a specific gravity greater than the specific gravity of said plastisol.

17. The invention as set forth in claims 15 hereof wherein the viscosity of said plastisol is from about 700 to about 2,000 cps.

18. The invention as set forth in claim 16 hereof wherein the viscosity of said plastisol is from about 700 to about 2,000 cps.

19. A syntactic foam structure obtained by fusing a mixture consisting essentially of about 65 to about 99 percent by weight of vinyl chloride polymer plastisol, from 0 to about 30 percent by weight of suspension grade resin and from about 1 to about 10 percent by weight of expanded perlite comprised essentially of particles having a diameter of from about 50 to about 1,000 microns.

20. The invention as set forth in claim 19 hereof wherein said perlite is comprised essentially of particles having a diameter of from about 100 to about 500 microns.

21. The invention as set forth in claim 19 hereof wherein said mixture comprises from about 2 to about 6 percent by weight of said perlite.

22. The invention as set forth in claim 21 hereof wherein said perlite is comprised essentially of particles having a diameter of from about 100 to about 500 microns.

23. The invention as set forth in claims 19, 20, 21 or 22 hereof wherein said perlite is substantially uniformly distributed throughout said structure.

24. The invention as set forth in claims 19, 20, 21, or 22 hereof wherein said perlite is disposed substantially adjacent one surface of said structure.

25. The invention as set forth in claim 24 hereof wherein said structure comprises a material having a specific gravity greater than the specific gravity of said plastisol, said material being disposed substantially adjacent a first surface of said structure and said perlite being disposed substantially adjacent a second surface thereof.

* * * * *